US005962861A

United States Patent [19]

Fowler

[11] Patent Number: 5,962,861

[45] Date of Patent: Oct. 5, 1999

[54] SHEET MEDIA WEIGHT DETECTOR AND METHOD

[75] Inventor: Pat Fowler, Middleton, Id.

[73] Assignee: Hewlett-Packard Company, Palo Alto, Calif.

[21] Appl. No.: 08/806,994

[22] Filed: Feb. 26, 1997

[51] Int. Cl.[6] ..... G01N 21/86

[52] U.S. Cl. ..... 250/559.27; 400/56

[58] Field of Search ..... 250/559.19, 559.27, 250/559.28, 223 R, 214 PR; 400/56, 708

[56] References Cited

U.S. PATENT DOCUMENTS

| | | | |
|---|---|---|---|
| 3,171,034 | 2/1965 | Tomasulo et al. | 250/214 RP |
| 3,968,364 | 7/1976 | Miller | 250/559.27 |
| 4,060,734 | 11/1977 | Tilley et al. | 250/559.27 |
| 4,866,984 | 9/1989 | Houghton | 73/159 |
| 4,937,460 | 6/1990 | Duncan et al. | 250/561 |
| 5,138,178 | 8/1992 | Wong et al. | 250/559 |
| 5,204,537 | 4/1993 | Bennet et al. | 250/560 |
| 5,519,481 | 5/1996 | Kuo | 355/309 |

FOREIGN PATENT DOCUMENTS

| | | |
|---|---|---|
| 0264968 | 4/1988 | European Pat. Off. . |
| 57-165874 | 10/1982 | Japan . |

*Primary Examiner*—Edward P. Westin
*Assistant Examiner*—Kevin Pyo

[57] ABSTRACT

A device that automatically detects the strength of the paper as an indicator of paper weight and thickness. The detector includes a deflector acting on the paper or other sheet media and a deflection sensor that is responsive to the deflection of the paper. The deflector may be gravity or a mechanical device, or a combination of both. A mechanical deflector typically will include a contact member and a gate member. The contact member is biased against and deflects the sheet media advancing past the detector. The sensor is in operative communication with the gate member of the deflector. The deflector is operative to move between a first position, wherein the sensor outputs a first signal, and a second position, wherein the sensor outputs a second signal.

15 Claims, 7 Drawing Sheets

SHEET MEDIA WEIGHT DETECTOR AND METHOD

FIELD OF THE INVENTION

The invention relates generally to detecting the weight of paper in printers and controlling printer operations according to the detected paper weight. More particularly, the invention relates to a deflection sensing device that detects the strength of the paper as an indicator of paper weight.

BACKGROUND OF THE INVENTION

Automatically detecting the weight of the paper used in a printer, copier or other image forming machine is desirable to help maintain good print quality. In laser printers and other electrophotographic image forming machines, the weight of the paper, as a discrete characteristic of the paper and as an indicator of paper thickness, is an important factor in determining the fusing temperature and pressure, the speed at which the paper is advanced through the printer and the transfer current needed for good print quality. Electrophotographic printers typically do not detect and automatically adjust for heavy paper—paper having a basis weight greater than about 28 pounds. Some printers allow the operator to manually select a heavy paper setting in the computer printer driver to maintain good print quality on heavy paper. Manual selection, however, is only effective if the operator is able to, and actually does, select the correct heavy paper setting. Manual selection is sometimes not practicable even for a knowledgeable and diligent operator, particularly when the printer paper is changed frequently among different weight and thickness papers and from several different input sources.

SUMMARY OF THE INVENTION

The present invention is directed to a device that automatically detects the strength of the paper as an indicator of paper weight and thickness. The detector includes a deflector acting on the paper or other sheet media and a deflection sensor that is responsive to the deflection of the paper. The deflector may be gravity or a mechanical device, or a combination of both. A mechanical deflector typically will include a contact member and a gate member. The contact member is biased against and deflects the sheet media advancing past the detector. The sensor is in operative communication with the gate member of the deflector. The deflector is operative to move between a first position, wherein the sensor outputs a first signal, and a second position, wherein the sensor outputs a second signal.

In one preferred embodiment of the invention, the deflector is a lever mounted for rotation on an axis. The sensor includes of a light source and a light sensor. The source and sensor are positioned with respect to one another so that light from the light source may be sensed by the light sensor. The area between the light source and the light sensor is referred to as the detection zone. When the lever is in a first position, corresponding for example to the greater deflection of light weight paper, the gate member is out of the detection zone and it does not block the light to the light sensor. In this case, the sensor outputs a signal indicating light weight paper. When the lever is in a second position, corresponding for example to the lesser deflection of heavier weight paper, the gate member is rotated into the detection zone and it blocks the light to the light sensor. In this case, the sensor outputs a signal indicating heavy weight paper.

The invention also provides a method for controlling print operations in image forming machines. The method includes the steps of (1) deflecting the sheet media, (2) sensing the degree of deflection the sheet media, and (3) controlling one or more printer operations according to the sensed degree of deflection.

DETAILED DESCRIPTION OF THE INVENTION

Figure 1:
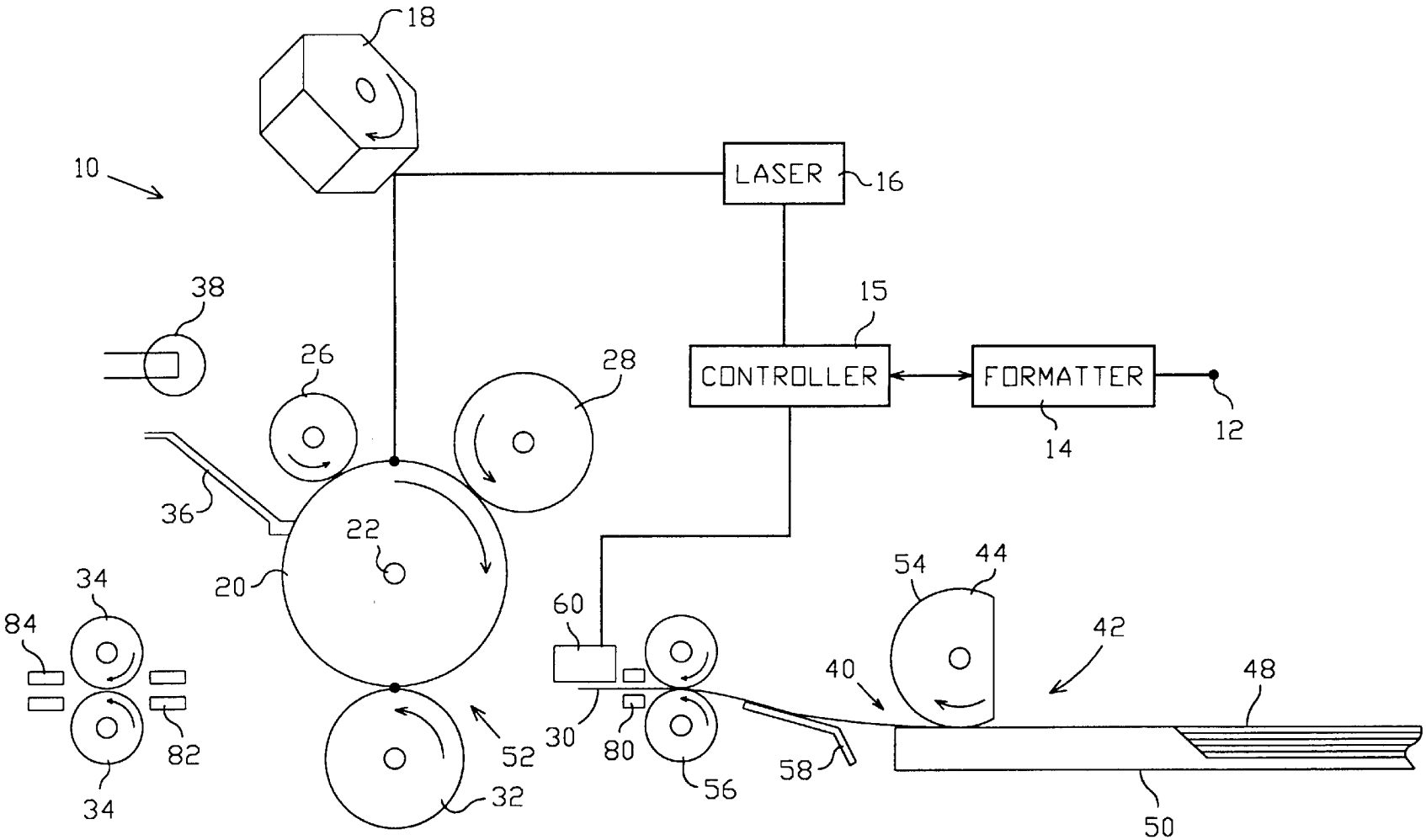
FIG. 1 is a representational elevation view of a laser printer that includes the sheet media detector of the present invention.

Although it is expected that the sheet media detector of the present invention will be most useful in electrophotographic printing devices such as the laser printer illustrated in FIG. 1, the detector can be used in the various sheet media type printers, copiers and other image forming devices. FIG. 1 illustrates a conventional laser printer, designated by reference number 10, adapted for use with the invented sheet media detector. In general, a computer transmits data representing an image to input port 12 of printer 10. This data is analyzed in formatter 14, which typically consists of a microprocessor and related programmable memory and page buffer. Formatter 14 formulates and stores an electronic representation of each page that is to be printed. Once a page has been formatted, it is transmitted to the page buffer. The page buffer, usually three or more individual strip buffers, breaks the electronic page into a series of lines or "strips" one dot wide. This strip of data is then sent to the printer controller 15. Controller 15, which also includes a microprocessor and programmable memory, drives laser 16 and controls the drive motor(s), fuser temperature and pressure, and the other print engine components and operating parameters.

Each strip of data is used to modulate the light beam produced by laser 16 such that the beam of light "carries" the data. The light beam is reflected off a multifaceted spinning mirror 18. As each facet of mirror 18 spins through the light beam, if reflects or "scans" the beam across the side of a photoconductive drum 20. Photoconductive drum 20 rotates about a motor-driven shaft 22 such that it advances just enough that each successive scan of the light beam is recorded on drum 20 immediately after the previous scan. In this manner, each strip of data from the page buffer is recorded on photoconductive drum 20 as a line one after the other to reproduce the page on the drum.

Photoconductive drum 20 is first charged using a high voltage charging roller 26 to have a negative polarity at its surface. The light beam discharges the area on drum 20 that it illuminates. This process creates a "latent" electrostatic image on drum 20. Developing roller 28 transfers toner onto photoconductive drum 20. Typically, a dry magnetic insulating toner is used. The toner is attracted to developer roller 28 by an internal magnet. The toner particles are charged to have a negative polarity. Developer roller 28 is electrically biased to repel the negatively charged toner to the discharge image areas on drum 20. In this way, the toner is transferred to photoconductive drum 20 to form a toner image on the drum.

The toner is transferred from photoconductive drum 20 onto paper 30 as paper 30 passes between drum 20 and transfer roller 32. Transfer roller 32 is electrically biased to impart a relatively strong positive charge to the back side of paper 32 as it passes by drum 20. The positive charge attracts the negatively charged toner and pulls it from drum 20 to form the image on paper 30. The toner is then fused to paper 30 as the paper passes between heated fusing rollers 34. The circumference of photoconductive drum 20 is usually less than the length of paper 30. Therefore, the drum must rotate several times to print a full page or sheet of paper. Drum 20 is cleaned of excess toner with cleaning blade 36, completely discharged by discharge lamps 38 and recharged by charging roller 26.

Each sheet of paper 30 is advanced to the photoconductive drum 20 by a pick/feed mechanism 42. Pick/feed mechanism 42 includes a feed roller 44 and registration rollers 56. Feed roller 44 usually has a generally D shaped perimeter so that feed roller 44 does not contact the paper stack between pick/feed commands. The paper stack 48 is positioned in input tray 50 to allow sliding passage of the top sheet of paper 30 into pick/feed area 40 at the urging of feed roller 44. Feed roller 44 has a frictionally adherent outer surface 54. In operation, as feed roller 44 rotates, the frictionally adherent outer surface 54 along the circular portion of the outer perimeter of feed roller 44 contacts the upper surface of paper 30 and pulls it into pick/feed area 40. As the leading edge of paper 30 moves through pick/feed area 40, it is engaged between a pair of registration rollers 56. Ramp 58 helps guide paper 30 into registration rollers 56. As registration rollers 56 move paper 30 into image area 52, the weight of paper 30 is detected by a paper weight detector 60. Registration rollers 56 advance paper 30 fully into image area 52 until it is engaged between drum 20 and transfer roller 32 and toner is applied as described above.

A conventional laser printer 10 typically also includes several photoelectric paper position sensors. For example, a first position sensor 80 is located just downstream of registration rollers 56 and second and third position sensors 82 and 84 are located on the upstream and downstream sides of fuser rollers 34. Other position sensors may also be used. The position sensors detect the presence of the paper at various locations in printer 10 to help time the operations of the printer components and to detect paper jams.

Figure 2:
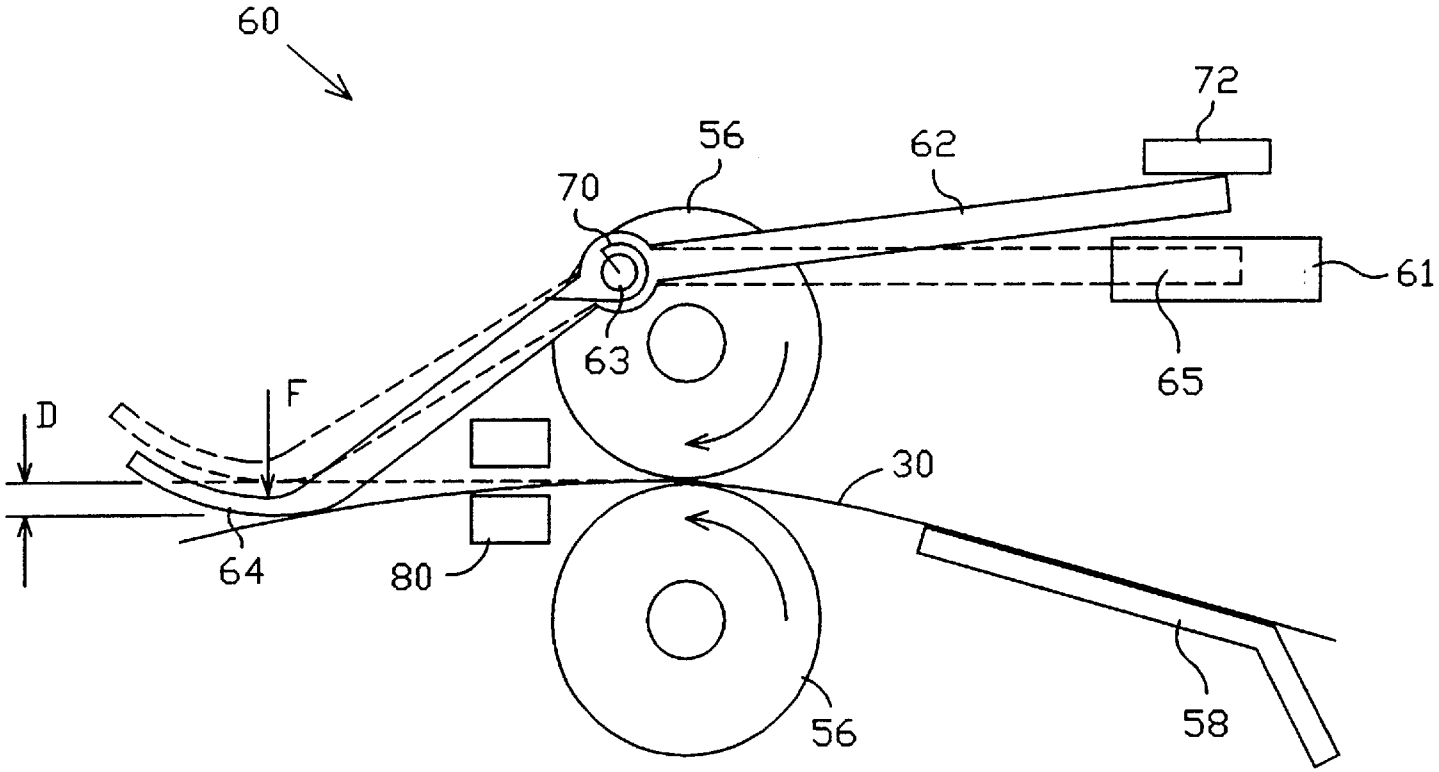
FIG. 2 is a detail elevation view of two position sheet media detector using a torsional spring biasing element.

Paper weight detector 60 is positioned downstream of registration rollers 56, preferably also downstream of first position sensor 80. One preferred embodiment of detector 60 is shown in FIG. 2. Referring to FIG. 2, detector 60 includes a sensor 61 and a lever 62. Detector 60 is shown in the foreground and one pair of registration rollers 56 is shown in the background. In this configuration, detector 60 is mounted near the center of paper 30 between two pairs of registration rollers (only one pair is shown) positioned near either side of paper 30. Lever 62 pivots on pivot pin 63. Pivot pin 63 is mounted to or integral with the printer chassis or another stable printer component. One end of lever 62 is constructed as a foot shaped member 64 to contact paper 30. The other end of lever 62 forms a gate member 65. As registration rollers 56 advance paper 30 toward photoconductive drum 20, foot shaped member 64 deflects the paper under a predetermined force F exerted by torsional spring 70 on lever 62. Torsional spring 70 is operatively coupled between lever 62 and pivot pin 63. A stop 72 mounted to the chassis or other stable printer component prevents unrestricted rotation of lever 62. The amount of deflection D of paper 30 is measured by sensor 61 and outputted to printer controller 15.

The weight and thickness of paper 30 can be computed in the microprocessor of controller 15 according to the appropriate algorithm or model. For example, it has been observed that 28#, 65# and 150# basis weight papers deflect a distance D of about 2 mm under a force F of 1, 3, and 6 grams-force, respectively, applied to the leading edge of the paper 25 mm downstream of registration rollers 56. The output from paper weight detector 60 is utilized by printer controller 15 to automatically control and direct operations of those print engine components and printing parameters that depend on paper weight or thickness, such as fusing temperature and pressure, the speed at which the paper is advanced through the printer and the transfer current (the electric current or electrostatic force that moves the toner onto the paper). These parameters and the components that control them can all be adjusted by controller 15 according to the output of detector 60. Preferably, detector 60 is positioned upstream of photoconductive drum 20 so that the output signal of detector 60 may be utilized by printer controller 15 to control photoconductive drum 20 and other downstream print engine components.

Figure 3:
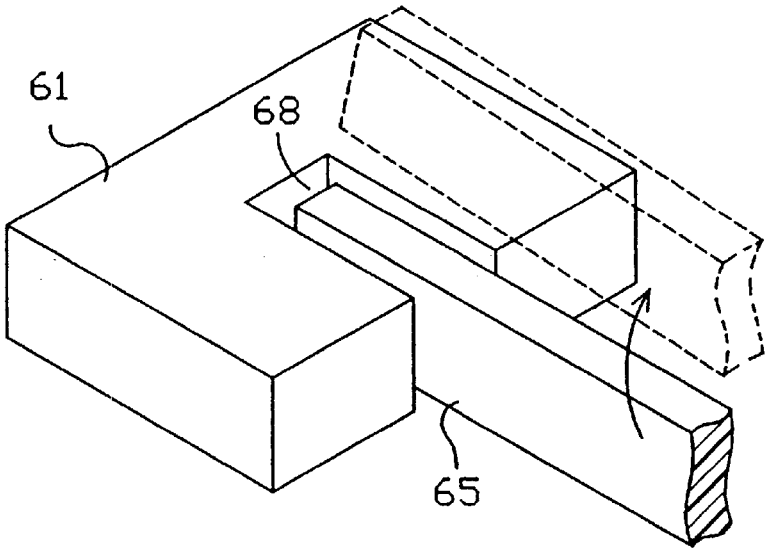
FIG. 3 is a partial detail isometric view showing the gate member in the detection zone of the photoelectric sensor.
Figure 5:
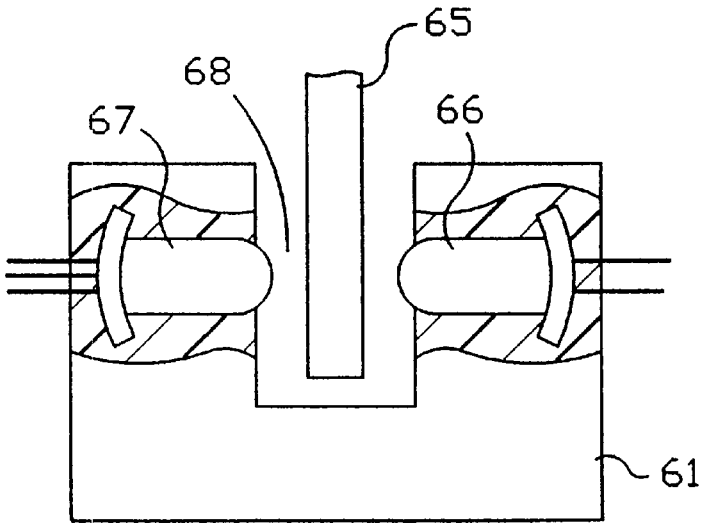
FIG. 5 is a top down plan view of the photoelectric sensor showing the LED and phototransistor.
Figure 4C:
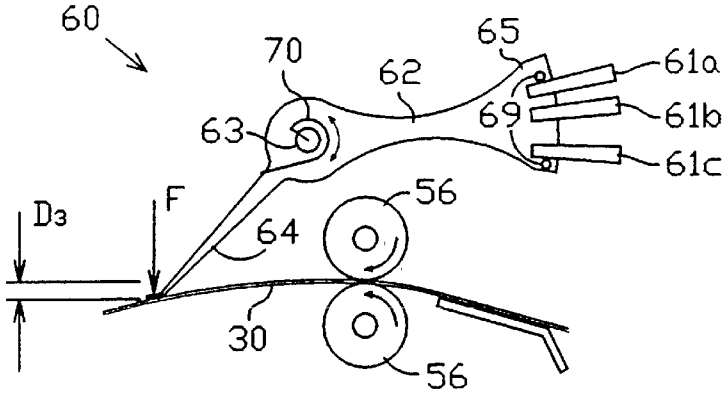
FIGS. 4*a*–4*d* are detail elevation views of a four position sheet media detector.
Figure 4D:
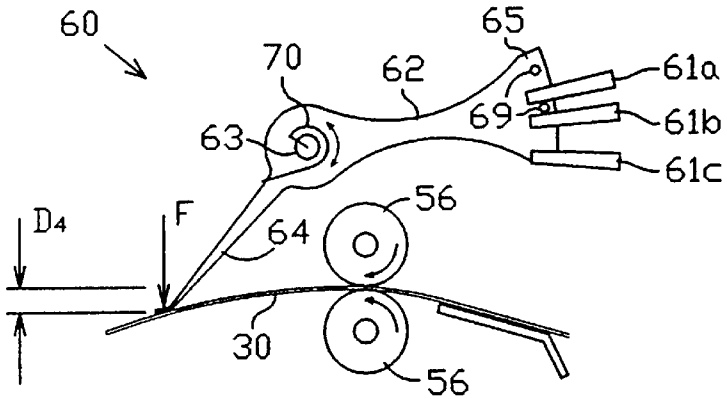
Figure 4A:
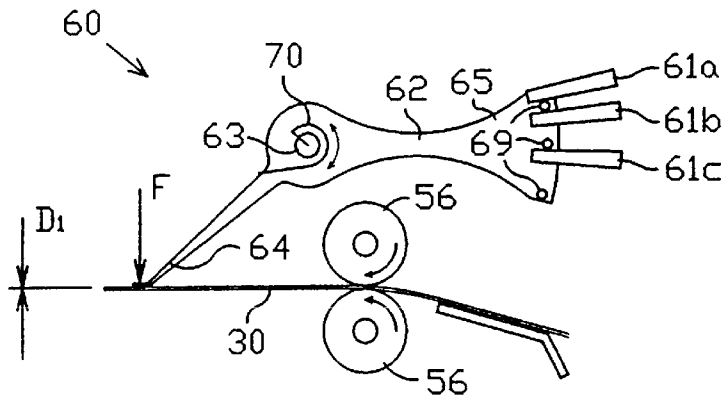
Figure 4B:
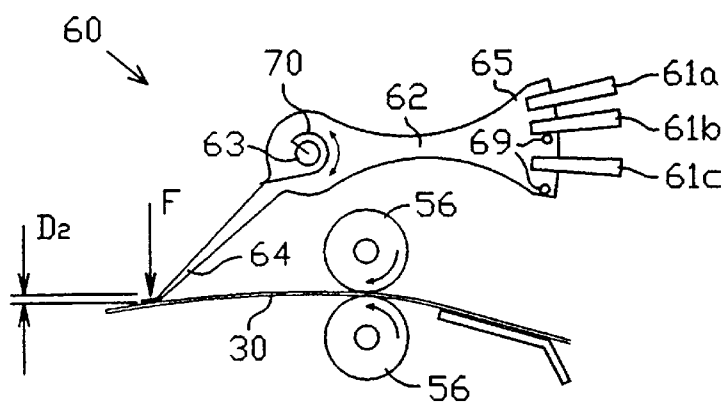

Referring to FIG. 5, sensor 61 includes a light emitting diode (LED) 66 and a phototransistor 67. A tungsten lamp, a neon lamp or any suitable source of light radiation, preferably infrared light, may be used an alternative to LED 66. Similarly, a photodiode, a photoresistor or any other suitable sensor of light may be used as an alternative to phototransistor 67. LED 66 and phototransistor 67 are mounted opposite one another in sensor 61. Gate member 65 of lever 62 passes through a detection zone 68 between LED 66 and phototransistor 67, as best seen in FIG. 3. The output signal from phototransistor 67, which is transmitted to printer controller 15, indicates the presence or absence of gate member 65 in detection zone 68.

In the embodiment of FIG. 2, if gate 65 remains out of detection zone 68 upon application of force F to the leading edge of paper 30, then phototransistor 67 senses the light emitted by LED 66 and detector 60 outputs a light paper signal to controller 15. If gate 65 moves into detection zone 68 upon application of force F to the leading edge of paper 30, then gate 65 blocks the light emitted by LED 66 and detector 60 outputs a heavy paper signal to controller 15. Added precision can be obtained by using more than one sensor. In the embodiment of the invention illustrated in FIGS. 4*a*–4*d*, gate member 65 passes through a series of three sensors 61*a*, 61*b*, and 61*c*. Using three sensors and three openings 69 in gate 65, four different deflection positions can be indicated. Openings 69 are positioned in gate 65 at predetermined intervals according to selected distances $D_1$, $D_2$, $D_3$, and $D_4$ of deflection of paper 30. Each distance $D_1$, $D_2$, $D_3$, and $D_4$ could represent the deflection of four different weights of paper, for example, or the difference between "light" and "heavy" paper at varying levels of humidity. Each deflection is determined by detector 60 according to the following table.

| | POSITION | | | |
|---|---|---|---|---|
| | D1 | D2 | D3 | D4 |
| Sensor 61a | light blocked | light sensed | light blocked | light blocked |
| Sensor 61b | light blocked | light blocked | light sensed | light blocked |
| Sensor 61c | light blocked | light blocked | light blocked | light sensed |

Figure 7:
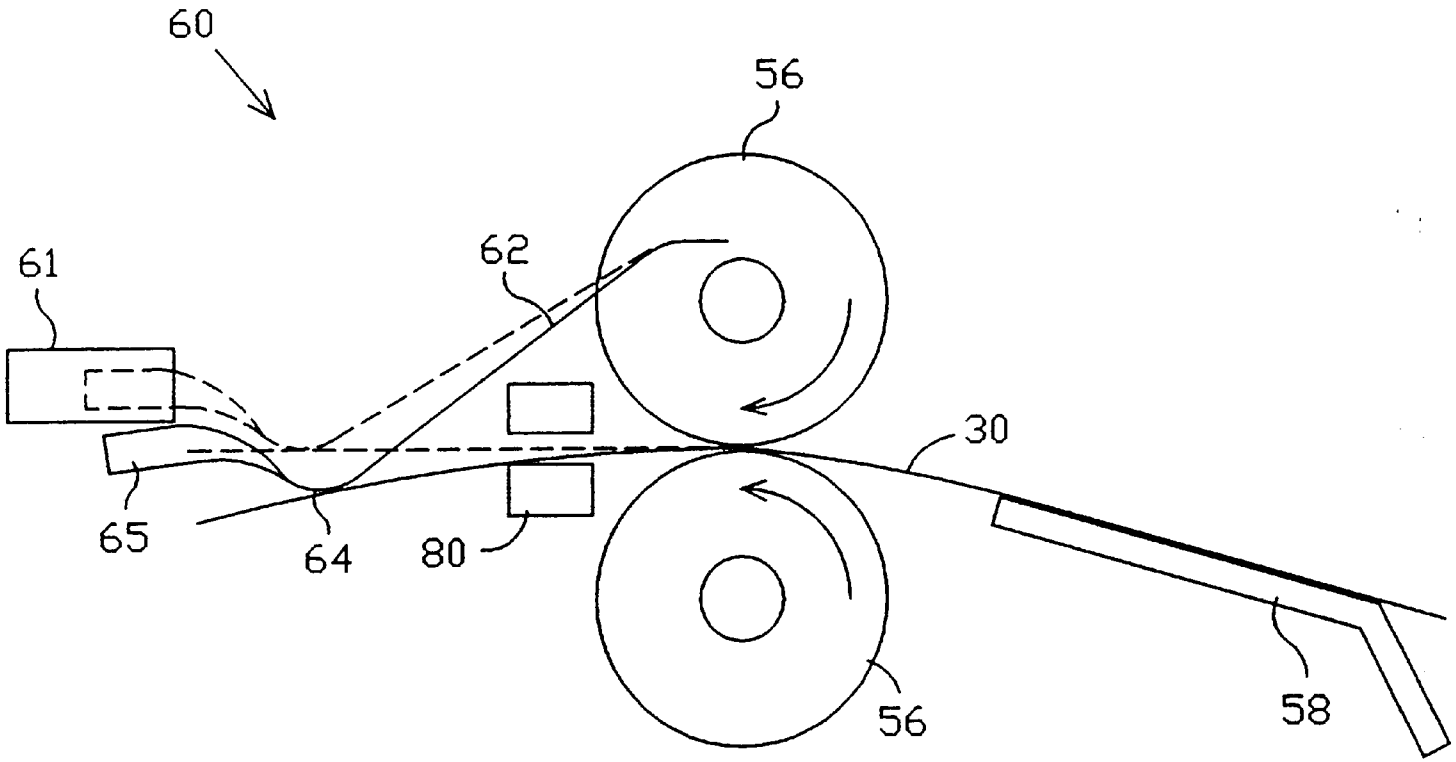
FIG. 7 is a detail elevation view of a two position sheet media detector using a spring tab type biasing element.

Paper 30 may be deflected using a variety of devices and techniques. For example, lever 62 might be constructed as a cantilevered spring tab, as shown in FIG. 7. In this embodiment of the invention, paper 30 contacts foot member 64 of spring tab type lever 62 as it is advanced along the paper path. For light weight paper that is more easily deflected, lever 62 remains at or near its down biased resting position, gate member 65 does not block the light emitted by LED 66 and detector 60 outputs a light paper signal to controller 15. The stronger heavy weight paper, which is not easily deflected, pushes lever 62 upward so that gate 65 blocks the light emitted by LED 66 and detector 60 outputs a heavy paper signal to controller 15.

Figure 8:
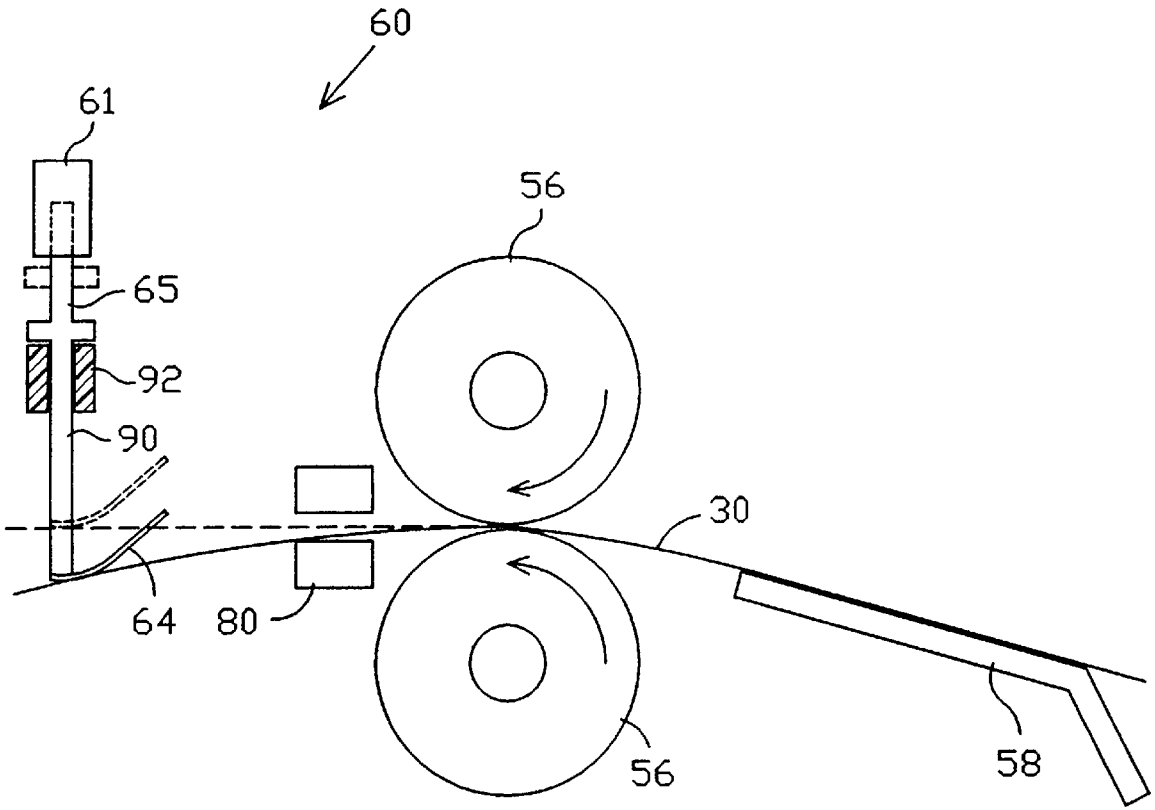
FIG. 8 is a detail elevation view of a two position sheet media detector using a weight biasing element.

In each of the embodiments shown and described above, a biasing element is used to position lever 62 to deflect paper 30 as the paper is advanced along the paper path. In FIG. 2, the biasing element is torsional spring 70. Alternatively, a weighted foot member 64 could be substituted for torsional spring 70 as the biasing element. In FIG. 7, the construction of lever 62 as a spring tab inherently provides this biasing element. Other configurations and constructions of detector 60 are possible. In FIG. 8, a vertically oriented shaft 90 is substituted for lever 62. Shaft 90 is weight biased downward to deflect paper 30. Shaft 90 is mounted in a casing 92. Casing 92 is attached to or part of the printer chassis or other stable printer component. The operation of detector 60 in FIG. 8 is essentially the same as in the other embodiments. Paper 30 contacts foot member 64 as it is advanced along the paper path. As paper 30 contacts foot member 64, shaft 90 deflects the paper. For light weight paper, shaft 90 remains at or near its down biased resting position, gate member 65 does not block the light emitted by LED 66 and detector 60 outputs a light paper signal to controller 15. Heavy weight paper pushes shaft 90 upward so that gate 65 blocks the light emitted by LED 66 and detector 60 outputs a heavy paper signal to controller 15. As a further alternative, the constant biasing elements shown and described above could be replaced with an intermittent biasing element triggered by one of the position sensors, preferably first position sensor 80. Or, gravity alone could be used to deflect the paper.

Figure 6:
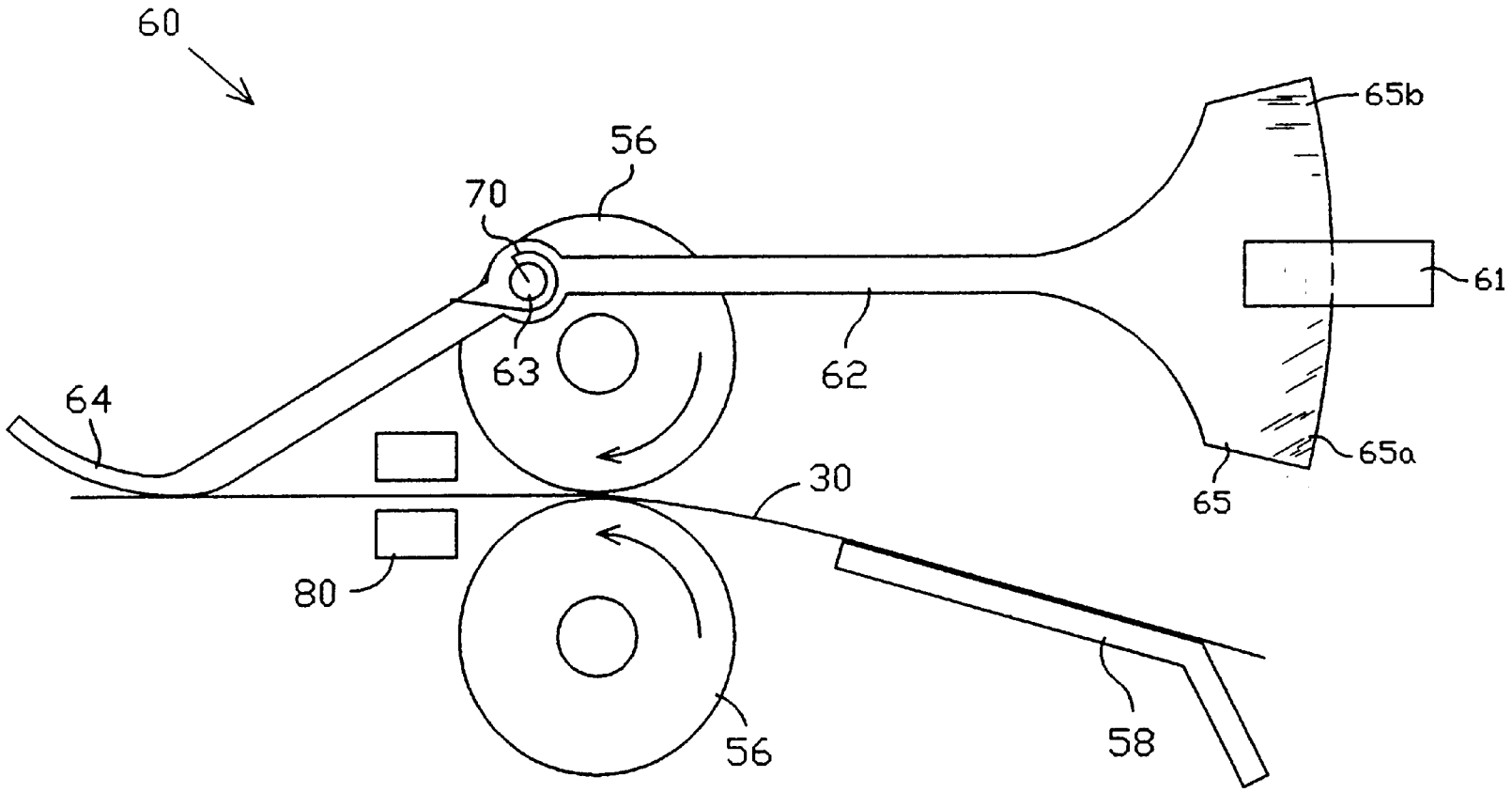
FIG. 6 is a detail elevation view of a multiple position sheet media detector that measures the deflection of the paper continuously rather than in discrete increments.

For the embodiments of detector 60 illustrated in FIGS. 2, 4, 7 and 8 phototransistor(s) 67 behaves like a digital ON/OFF device responding to the presence or absence of gate 65 in detection zone 64. In an alternative embodiment of detector 60 illustrated in FIG. 6, gate 65 is made to transmit a varying degree of the infrared light emitted by LED 67. The light transmissibility of gate 65 varies from a first translucent portion 65*a* to a second opaque portion 65*b*. Preferably, the degree of light transmission varies substantially in a continuum between the first translucent portion 65*a*, in which the light is transmitted freely, to the second opaque portion 65*b* in which the light is blocked. In this embodiment, phototransistor 67 acts as a linear analog device responding to the degree of light passing through gate 65 and, correspondingly, to the degree of deflection of paper 30. Thus, the degree of deflection and, therefore, the weight of the paper can be measured continuously rather than in discrete increments.

Although the invention has been shown and described with reference to the foregoing preferred embodiments, which utilize a mechanical deflector and a photoelectric sensor, the invention may be embodied in other deflector/sensor pairs. Various configurations of Hall effect transducers, simple electromechanical switches, analog transducers, potentiometers and sonic transducers might be used as alternatives to those shown and described without departing from the spirit and scope of the invention as defined in following claims.

What is claimed is:

1. A sheet media weight detector, comprising:

a movable deflector having a contact member and a gate member, the contact member biased against and reflecting a single sheet advancing past the detector;

a sensor in operative communication with the gate member; and the deflector operative to move between a first position in which there is no sheet media advancing past the contact member and the sensor outputs a first signal, and a second position in which a single sheet is advancing against and deflecting the contact member causing the deflector to move and the sensor outputs a second signal different from the first signal.

2. A detector according to claim 1, wherein the sensor comprises a light source and a light sensor disposed with respect to one another so that light from the light source may be sensed by the light sensor.

3. A detector according to claim 2, wherein the gate member blocks light to the light sensor when the deflector is in the first position and the gate member does not block light to the light sensor when the deflector is in the second position.

4. A detector according to claim 2, further comprising a detection zone between the light source and the light sensor, the gate member passable through the detection zone, the gate member having a variable degree of light transmissibility extending from a first translucent portion to a second opaque portion so that a varying degree of light is transmitted according to the position of the gate member in the detection zone.

5. A detector according to claim 2, further comprising a detection zone between the light source and the light sensor, the gate member passable through the detection zone, the gate member having a plurality of openings therein at spaced apart intervals so that light is selectively transmitted or blocked according to the position of the gate member in the detection zone.

6. A sheet media weight detector, comprising:

an elongated member having a first end configured to contact a sheet and a second end configured as a gate, the elongated member rotatable mounted on an axis positioned between the first end and the second end;

a sensor in operative communication with the gate ,the sensor comprising a light source and a light sensor disposed with respect to one another so that light from the light source may be sensed by the light sensor, and a detection zone between the light source and the light sensor;

a biasing element operatively coupled to the elongated member so that the first end of the elongated member applies a force to and deflects a sheet advancing past the first end of the elongated member;

the elongated member operative to rotate the gate through a plurality of positions in the detection zone according to the degree of deflection of the sheet contacting the first end of the elongated member wherein the sensor outputs a plurality of signals representing the degree of deflection of the sheet contacting the first end of the elongated member..

7. A detector according to claim 6, wherein the biasing element comprises at least a portion of the weight of the elongated member.

8. A detector according to claim 6, wherein the elongated member is a lever rotatably mounted on an axis.

9. A detector according to claim 8, wherein the biasing element comprises at least a portion of the weight of the lever.

10. A detector according to claim 8, wherein the biasing element comprises a torsional spring operatively coupled between the lever and the axis.

11. A sheet media detector according to claim 1, further comprising a stop disposed adjacent to the gate member, the stop blocking movement of the deflector in one direction to hold the deflector in the first position.

12. A sheet media detector according to claim 1, wherein the deflector is pivotally mounted on an axis positioned between the contact member and the gate member.

13. A sheet media detector according to claim 1, wherein deflector comprises a cantilevered spring tab pivotally mounted on an axis, the contact member positioned between the axis and the gate member.

14. A sheet media detector according to claim 6, wherein the gate has a variable degree of light transmissibility extending from a first translucent portion to a second opaque portion so that a varying degree of light is transmitted according to the position of the gate in the detection zone.

15. A sheet media detector according to claim 6, wherein the sensor comprises a plurality of sensors and the gate has a plurality of openings therein a spaced apart intervals so that light is selectively transmitted or blocked according to the position of the gate in the detection zone.

* * * * *